US010453328B2

(12) United States Patent
Ricks

(10) Patent No.: US 10,453,328 B2
(45) Date of Patent: Oct. 22, 2019

(54) SYSTEMS AND METHODS FOR CROWDSOURCING DETECTED EVENTS

(71) Applicant: Vivint, Inc., Provo, UT (US)

(72) Inventor: Sean Ricks, American Fork, UT (US)

(73) Assignee: Vivint, Inc., Provo, UT (US)

( * ) Notice: Subject to any disclaimer, the term of this patent is extended or adjusted under 35 U.S.C. 154(b) by 57 days.

(21) Appl. No.: 14/252,058

(22) Filed: Apr. 14, 2014

(65) Prior Publication Data

US 2015/0294543 A1 Oct. 15, 2015

(51) Int. Cl.
*G08B 27/00* (2006.01)

(52) U.S. Cl.
CPC ..... *G08B 27/003* (2013.01); *G08B 27/00* (2013.01)

(58) Field of Classification Search
CPC ..... H04H 20/59; G06F 3/0484; H04W 4/22; G08B 13/122; G08B 13/19
USPC ..... 340/932, 989, 995.1, 541
See application file for complete search history.

(56) References Cited

U.S. PATENT DOCUMENTS

2006/0075356 A1* 4/2006 Faulkner ..... G06T 17/05 715/782
2010/0280637 A1* 11/2010 Cohn ..... G08B 29/02 700/90
2011/0068915 A1* 3/2011 Wakefield, III ..... G01S 5/0009 340/539.13
2013/0012236 A1* 1/2013 Cornett ..... G01S 5/0027 455/456.3
2013/0097246 A1* 4/2013 Zifroni ..... G06Q 50/01 709/204
2014/0087780 A1* 3/2014 Abhyanker ..... H04W 4/90 455/521
2014/0340216 A1* 11/2014 Puskarich ..... G08B 17/11 340/539.11
2015/0222672 A1* 8/2015 Vaughn ..... G06F 15/16 709/204
2016/0173963 A1* 6/2016 Filson ..... H04L 12/1895 340/870.09
2016/0283715 A1* 9/2016 Duke ..... G06F 21/566

* cited by examiner

*Primary Examiner* — Hai Phan
*Assistant Examiner* — Anthony D Afrifa-Kyei
(74) *Attorney, Agent, or Firm* — Holland & Hart LLP

(57) ABSTRACT

A computer-implemented method for crowdsourcing detected events is described. In one embodiment, an event is detected via one or more sensors located at a first location within a predetermined geographic area. Data from the one or more sensors is analyzed to determine a scope of the event. Upon determining the scope of the event affects a second location within the predetermined geographic area, a notification is sent to a user associated with a location within the predetermined geographic area that does not include a sensor of a type that detects the event.

19 Claims, 6 Drawing Sheets

SYSTEMS AND METHODS FOR CROWDSOURCING DETECTED EVENTS

BACKGROUND

Advancements in media delivery systems and media-related technologies continue to increase at a rapid pace. Increasing demand for media has influenced the advances made to media-related technologies. Computer systems have increasingly become an integral part of the media-related technologies. Computer systems may be used to carry out several media-related functions. The wide-spread access to media has been accelerated by the increased use of computer networks, including the Internet and cloud networking.

Many homes and businesses use one or more computer networks to generate, deliver, and receive data and information between the various computers connected to computer networks. Users of computer technologies continue to demand increased access to information and an increase in the efficiency of these technologies. Improving the efficiency of computer technologies is desirable to those who use and rely on computers.

With the wide-spread use of computers and mobile devices has come an increased presence of and continued advancements in building and residential automation, and building and residential security products and systems. For example, advancements in mobile devices allow users to monitor a home or business from anywhere in the world. Nevertheless, benefits may be realized by providing systems and methods for improving notifications in relation to these automation and security systems.

SUMMARY

According to at least one embodiment, a computer-implemented method for crowdsourcing detected events is described. In one embodiment, an event may be detected via one or more sensors located at a first location within a predetermined geographic area. The event may include at least one of a wildfire, a tsunami, a tornado, flooding, a hurricane, a typhoon, a dust storm, high winds, biological contamination, chemical contamination, burglary, property damage, and wherein the one or more sensors are configured to detect at least one of these events. Data from the one or more sensors may be analyzed to determine a scope of the event. Upon determining the scope of the event affects a second location within the predetermined geographic area, a notification may be sent to a user associated with a location within the predetermined geographic area that does not include a sensor of a type that detects the event.

In some embodiments, a type of event that is detected may be determined based at least on the type of the one or more sensors. Based on the type of event detected, an information service related to the type of event detected may be identified. The notification sent to the user may be generated based on at least one of information related to the type of event detected and information received from the identified information service.

In some embodiments, an estimated path related to the detected event may be computed by analyzing at least one of information from the one or more sensors located within the predetermined geographic area; information from one or more sensors located outside the predetermined geographic area; and/or information received from the information service related to the type of event detected. A notification may be sent to a user associated with a location outside the predetermined geographic area based on the estimated path.

In some cases, a number of locations that are confirmed to have detected the event may be indicated in the notification. Additionally, or alternatively, a position of each location confirmed to have detected the event may be indicated on a graphical map included in the notification. The notification may be sent using a selected messaging service and/or via a selected social network. A user such as an owner of a dwelling associated with the predetermined geographic area or an administrator of a system may select the means of communicating the message.

A computing device configured to identify a source of a suspect event is also described. The device may include a processor and memory in electronic communication with the processor. The memory may store instructions that are executable by the processor to detect an event via one or more sensors located at a first location within a predetermined geographic area, analyze data from the one or more sensors to determine a scope of the event, and upon determining the scope of the event affects a second location within the predetermined geographic area, send a notification to a first device associated with the second location.

A computer-program product to identify a source of a suspect event is also described. The computer-program product may include a non-transitory computer-readable medium that stores instructions. The instructions may be executable by a processor to detect an event via one or more sensors located at a first location within a predetermined geographic area, analyze data from the one or more sensors to determine a scope of the event, and upon determining the scope of the event affects a second location within the predetermined geographic area, send a notification to a first device associated with the second location.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
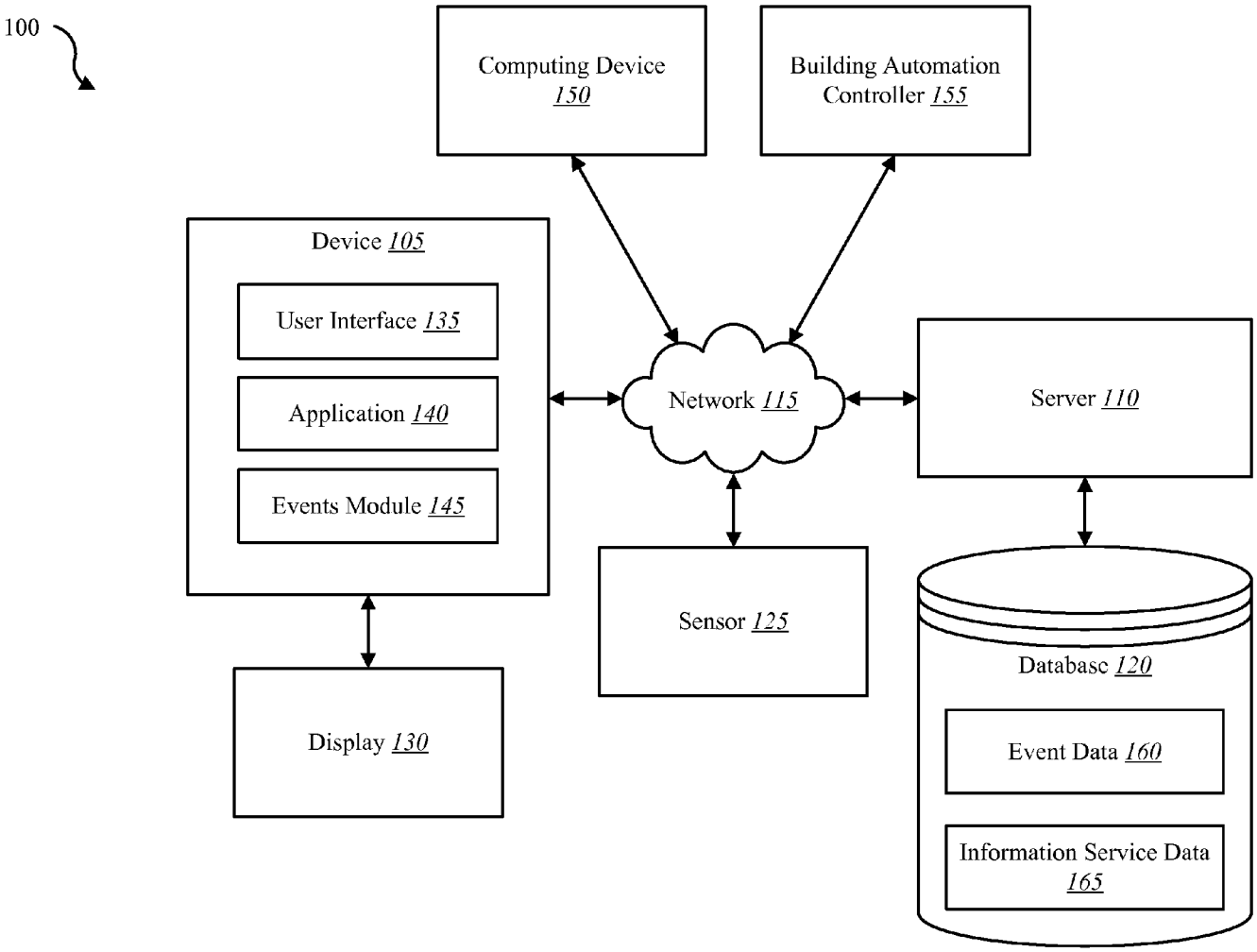
FIG. 1 is a block diagram illustrating one embodiment of an environment in which the present systems and methods may be implemented.

While the embodiments described herein are susceptible to various modifications and alternative forms, specific embodiments have been shown by way of example in the drawings and will be described in detail herein. However, the exemplary embodiments described herein are not intended to be limited to the particular forms disclosed.

Rather, the instant disclosure covers all modifications, equivalents, and alternatives falling within the scope of the appended claims.

DETAILED DESCRIPTION OF EXEMPLARY EMBODIMENTS

The systems and methods described herein relate to building and residential automation and security systems. More specifically, the systems and methods described herein relate to crowdsourcing detected events in relation to a building and residential automation system. Some embodiments of the systems and methods described herein relate to crowdsourcing detected events in relation to an integration of building or residential automation and a messaging service.

In one example, a user associated with a particular geographic area (a city, a neighborhood, etc.) may desire to receive an alert in association with the monitoring of events at the particular geographic area. The area may include an area of a home, a business, a building, etc. Additionally, or alternatively, the area may include an outdoor area such as an area associated with a park, a lake, a river, a forested area, etc. In one example, a first occupant of a first dwelling with the particular geographic area may install a sensor at the dwelling to detect flooding. A second occupant of a second dwelling in the same geographic area may lack a flood sensor. Nevertheless, both the first and second occupants may want to be alerted when flooding is occurring in the geographic area.

Presently, if the second occupant wanted to know whether flooding was occurring in the area of his or her dwelling, the second occupant may learn of the flooding from a news report delivered from a television, radio, and/or the Internet. In some cases, the second occupant may receive a phone call from a neighbor that lives in the area. In any case, the second occupant is more likely to not learn of the flooding in a timely fashion. Likewise, the first occupant may learn of the flooding in the same manner. Additionally, the first occupant may learn of the flooding if the flooding sensor of the first dwelling detects flooding inside the first dwelling. Nevertheless, the first occupant may want to learn of flooding in the geographic area before it occurs in his or her dwelling. Accordingly, the present systems and methods provide the means for notifying in real-time the first and the second occupants of the flooding in a timely manner. In the one case, the first occupant may receive a notification before the flood sensor of the first dwelling detects the flooding, or before the flooding spreads to the first dwelling. Additionally, the second occupant may receive a notification of the flood even though the second dwelling does not include a flood sensor.

FIG. 1 is a block diagram illustrating one embodiment of an environment 100 in which the present systems and methods may be implemented. In some embodiments, the systems and methods described herein may be performed on a device (e.g., device 105). The environment 100 may include a device 105, server 110, a sensor 125, a display 130, a computing device 150, a building automation controller 155, and a network 115 that allows the device 105, the server 110, the computing device 150, building automation controller 155, and sensor 125 to communicate with one another.

Examples of the device 105 include media content set top box, satellite set top box, cable set top box, DVRs, personal video recorders (PVRs), mobile devices, smart phones, personal computing devices, computers, laptops, desktops, servers, etc. In some cases device 105 may include a building automation controller. Examples of the building automation controller 155 may include any device configured to control a building such as a home, a business, etc. Accordingly, examples of building automation controller 155 include a dedicated building automation computing device (e.g., wall-mounted controller), a personal computing device (e.g., laptop, desktop, etc.), a mobile computing device (e.g., tablet computing device, smartphone, etc.), and the like. Examples of computing device 150 may include a mobile computing device, a laptop, a desktop, a server, etc. Examples of server 110 may include a data server, a server associated with a building automation service provider, a server of an information services such as national weather service, etc.

Examples of sensor 125 include a camera sensor, audio sensor, forced entry sensor, shock sensor, proximity sensor, boundary sensor, temperature sensor, light beam sensor, three-dimensional (3-D) sensor, motion sensor, airpressure sensor, air particulate sensor, smoke sensor, flood sensor, glass break sensor, door sensor, window sensor, carbon monoxide sensor, accelerometer, global positioning system (GPS) sensor, indoor positioning system (IPS) sensor, a Wi-Fi positioning system sensor, capacitance sensor, radio frequency sensor, a short-range wireless sensor (near-field communication (NFC) sensor, radio-frequency identifier (RFID), low-power BLUETOOTH® sensors, etc.), heartbeat sensor, breathing sensor, oxygen sensor, carbon dioxide sensor, brain wave sensor, movement sensor, voice detection sensor, biological sensor, chemical sensor, flammable gas detection sensor, gas line pressure sensor, gas accumulation sensor, wind speed sensor, and the like.

Sensor 125 may represent one or more separate sensors or a combination of two or more sensors in a single device. For example, sensor 125 may represent one or more camera sensors and one or more motion sensors connected to environment 100. Additionally, or alternatively, sensor 125 may represent a combination sensor such as both a camera sensor and a motion sensor integrated in the same device. Sensor 125 may be integrated with a facial recognition system. Although sensor 125 is depicted as connecting to device 105 over network 115, in some embodiments, sensor 125 may connect directly to device 105. Additionally, or alternatively, sensor 125 may be integrated with a home appliance or fixture such as a light bulb fixture. Sensor 125 may include an accelerometer to enable sensor 125 to detect a movement. For example, sensor 125 may be attached to a set of golf clubs in a garage area. Sensor 125 may include a wireless communication device enabling sensor 125 to send and receive data and/or information to and from one or more devices in environment 100. Additionally, or alternatively, sensor 125 may include a GPS sensor to enable sensor 125 to track a location of sensor 125 associated with a user. Sensor 125 may include a proximity sensor to enable sensor to detect proximity of a person relative to a predetermined distance from a dwelling (e.g., geo-fencing).

In some configurations, the device 105 may include a user interface 135, application 140, and events module 145. Although the components of the device 105 are depicted as being internal to the device 105, it is understood that one or more of the components may be external to the device 105 and connect to device 105 through wired and/or wireless connections. In some embodiments, application 140 may be installed on computing device 150 in order to allow a user to interface with a function of device 105, events module 145, building automation controller 155, and/or server 110.

In some embodiments, device 105 may communicate with server 110 via network 115. Example of networks 115 may include cloud networks, local area networks (LAN), wide area networks (WAN), virtual private networks (VPN), wireless networks (using 802.11, for example), cellular networks (using 3G and/or LTE, for example), etc. In some configurations, the network 115 may include the Internet. It is noted that in some embodiments, the device 105 may not include an events module 145. For example, device 105 may include application 140 that allows device 105 to interface with building automation controller 155 vian events module 145 located on another device such as computing device 150 and/or server 110. In some embodiments, device 105, building automation controller 155, and server 110 may include an events module 145 where at least a portion of the functions of events module 145 are performed separately and/or concurrently on device 105, building automation controller 155, and/or server 110. Likewise, in some embodiments, a user may access the functions of device 105 and/or building automation controller 155 (directly or through device 105 vian events module 145) from computing device 150. For example, in some embodiments, computing device 150 includes a mobile application that interfaces with one or more functions of device 105, building automation controller 155, events module 145, and/or server 110.

In some embodiments, server 110 may be coupled to database 120. Database 120 may include event data 160 and information service data 165. For example, device 105 may access event data 160 in database 120 over network 115 via server 110. Event data 160 may include data regarding past and/or current detected events. Information service data 165 may include data related to an information service such as the national weather service (NWS), etc. Database 120 may be internal or external to the server 110. In one example, device 105 may be coupled directly to database 120, database 120 being internal or external to device 105.

Events module 145 may allow a user to receive notifications regarding events detected in a predetermined geographic area and/or events that area predicted to be associated with a geographic area. In some configurations, application 140 may enable device 105 to interface with building automation controller 155 vian events module 145 to provide access to notification information to device 105 and/or computing device 150. Thus, application 140, via the events module 145, may allow users to receive notifications regarding a predetermined geographic area. Further details regarding the events module 145 are discussed below.

Figure 2:
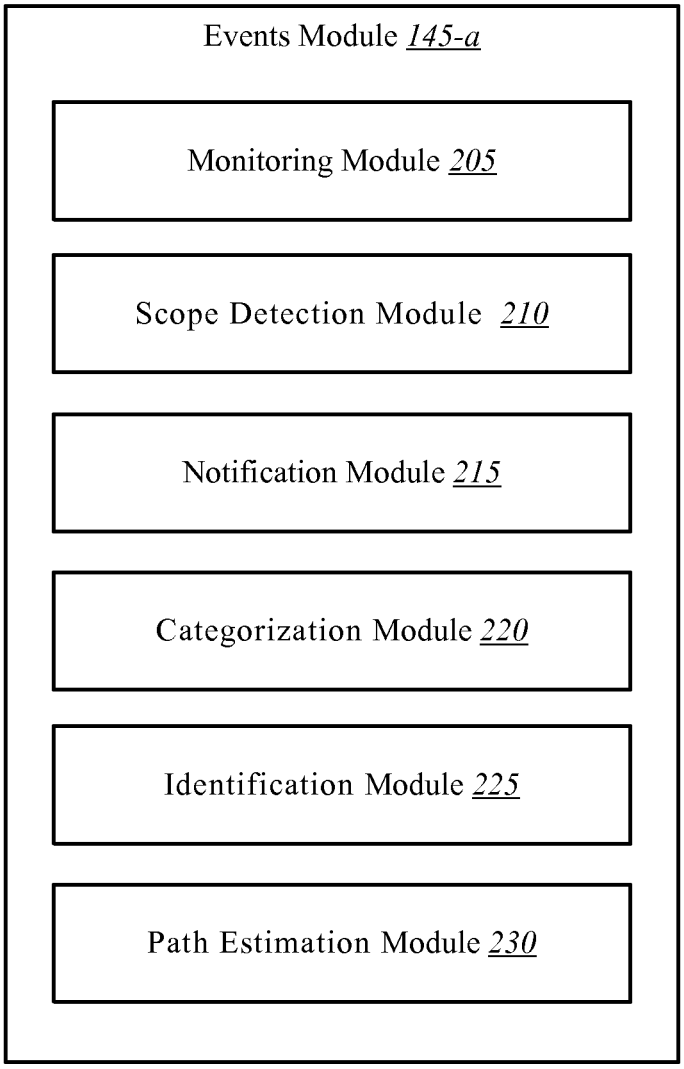
FIG. 2 is a block diagram illustrating one example of an events module.

FIG. 2 is a block diagram illustrating one example of an events module 145-*a*. Events module 145-*a* may be one example of events module 145 depicted in FIG. 1. As depicted, events module 145-*a* may include monitoring module 205, a scope detection module 210, a notification module 215, a categorization module 220, an identification module 225, and a path estimation module 230.

In one embodiment, monitoring module 205 may be configured to monitor events within a detectable area. In some cases the detectable area may be associated with at least a portion of an indoor area of a building such as a home or place of business. Additionally, or alternatively, the detectable area being monitored by the monitoring module 205 may include at least a portion of an outdoor area such as an area outside a home or place of business. In some cases the detectable area may be associated with an outdoor area such as an open field, a forest, a park, a recreation area, a reservoir, a parking lot, etc. Accordingly, monitoring module 205 may detect an event via one or more sensors located at a first location within a predetermined geographic area. In some cases, the one or more automation systems may include a building automation system such as a home automation system, a business building automation system, a government facility automation system, and the like. The detected event may include any event detectable by a sensor of an automation system. In some cases, the event may include a wildfire, a tsunami, a tornado, a flood, a hurricane, a typhoon, a dust storm, high winds, a burglary, property damage, and the like. One or more sensors may be configured to detect at least one of these events. In some cases, the sensors may detect biological and/or chemical contamination in the air, water, ground, etc. For example, biological and chemical sensors may determine whether a ventilation system is infected with contaminants that affect human health. In some cases, carbon monoxide and carbon dioxide sensors may sense whether concentration of these gases in the air exceed a threshold, either due to fire or ventilation problems indoors or outdoors.

In one embodiment, scope detection module 210 may be configured to analyze data from the one or more sensors to determine a scope of the event. For example, scope detection module 210 may determine whether the event is isolated to a single location within a specified geographic area, or whether the event involves multiple locations within the specified geographic area. For example, scope detection module 210 may determine that the event is isolated to a single structure such as a home or business. Likewise, scope detection module 210, may determine that the event is not isolated to a single location within the predetermined geographic area. In one example, scope detection module 210 may determine that a sensor at a first location detects an event. Based on the type of event detected, scope detection module 210 may query one or more additional sensors located within a predetermined range of the first location to determine whether other sensors are indicating detection of a similar event. Thus, other systems may be queried to determine whether data being collected at these other locations indicate events similar to the event detected at the first location.

The scope detection module 210 may determine that a similar event is being detected at least at a second location. In some embodiments, scope detection module 210 may continually receive data in real-time that relates to detected events from multiple locations. Thus, instead of, or in addition to, querying for data, scope detection module 210 may receive data from multiple locations regarding detected events in those multiple locations. The data may be stored in a storage device that the scope detection module 210 may access to query and analyze data received from multiple locations.

In some embodiments, scope detection module 210 may determine that an event detected at a first location is more likely to be related to an event detected at a second location based on the times of the detections. Thus, the scope detection module 210 may determine that the similar event detected at the second location occurs within a predetermined time of the event being detected at the first location. In some cases, scope detection module 210 may determine that an event detected at a first location is more likely to be related to an event detected at a second location based on the proximity of the second location in relation to the first location.

The scope detection module 210 may determine a proximity of the second location in relation to the first location. For example, upon determining a fire is detected at a first location, scope detection module 210 may query other systems from other locations within a predetermined range of the first location to determine whether systems at the other locations are indicating detection of a fire. Based on the proximity of the first and other locations, and the coincidence of the times of detection, scope detection module 210 may determine that multiple detections of the event indicate that the scope of the event is beyond a single location, structure, dwelling, home, or business. Accordingly, upon determining the scope of the event affects multiple locations within the predetermined geographic area, notification module 215 may be configured to send a notification to a user associated with a location within the predetermined geographic area that does not include a sensor of the type that detects the event. For example, a first home in a particular neighborhood may include an automation system that includes a flooding sensor. A second home in the same neighborhood may include a similar automation system that includes a similar flooding sensor. Finally, a third home in the same neighborhood may not include an automation system, or if it does, the third home includes an automation system without a flooding sensor. In any case, the user of this example may subscribe to an events subscription service.

The events subscription service may be provided to any user to enable subscribing users to receive alerts regarding detected events. Thus, the flooding sensor of the first home may detect a flood condition. The flooding sensor of the second home may also detect a flood condition. Accordingly, events module 145 may determine that the detected events indicate that the flood is not isolated to a single dwelling, but is widespread among multiple structures within the neighborhood. The owners of the first and second homes may receive notification from their respective automation systems. Additionally, because the owner of the third home subscribes to the events subscription service, the owner of the third home may receive notification from the subscription service, the notification indicating that flooding is occurring in his or her neighborhood. Thus, the owner of the third home may receive a notification regarding the flooding even though this owner's home does not include a flood sensor.

In one embodiment, categorization module 220 may determine a type of event that is detected. In one case, categorization module 220 may determine the type of event based on the type sensor that detects the event. For example, categorization module 220 may determine that a flood is occurring based on the fact that a flood sensor is detecting a level of water at the location of the sensor. Additionally, or alternatively, categorization module 220 may determine a type of an event based on characteristics of the data generated by the sensor sensing the event. For example, in one case, certain levels of detected carbon monoxide from a carbon monoxide detector may indicate a natural gas leak within a structure, whereas other detected levels of carbon monoxide may indicate a fire. In some cases, categorization module 220 may query information received from an information service upon receiving data regarding a detected event. Categorization module 220 may use information received from the information service to assist in determining the type of event detected. Examples of information services may include information provided by a government information broadcast service, information provided by a corporate information broadcast service, and the like. For example, the information service may include data and analysis provided by the National Weather Service (NWS), the National Oceanic and Atmospheric Administration (NOAA), Emergency Alert System (EAS), AMBER alert system, etc.

In some embodiments, information received from the information service may be received by a subscription to an information feed provided by the information service, where information is provided according to data generated from the devices and systems of the information service and/or according to analysis performed by the information service. Accordingly, events module 145 may receive information from the information service periodically and/or events module 145 may query the information service for service on a regular basis and/or in response to detection of events. Accordingly, events module 145 may analyze information received from an information service via its various modules and generate a notification based on the analysis. In some cases, past data received from the information service may be analyzed (e.g., to detect patterns, etc.). Additionally, or alternatively, real-time data from the information service received by subscription and/or by query may be used by the events module 145 to analyze an event. For example, data from the information service may contribute to the determination of the type of event detected, to the determination of the scope of the event, the determination of an estimated path associated with the event, and the like. For instance, events module 145 may use data provided by the information service to determine whether an event is an isolated occurrence, whether an event likely affects multiple locations within the predetermined geographic area, whether an event likely affects locations outside the predetermined geographic area, and/or a likely path of an event that is detected to be spreading.

In one embodiment, identification module 225 may identify, based on the type of event detected by the monitoring module 205, an information service related to the type of event being detected. Accordingly, notification module 215 may generate the notification based on information related to the type of event detected (e.g., data senses by the sensor that detected the event) and/or information received from the identified information service.

In some embodiments, path estimation module 230 may compute an estimated path related to the detected event by analyzing information from the one or more sensors located within the predetermined geographic area. Additionally, or alternatively, path estimation module 230 may compute an estimated path related to the detected event by analyzing information from one or more sensors located outside the predetermined geographic area. In some cases, path estimation module 230 may compute an estimated path related to the detected event by analyzing information received from the information service related to the type of event detected. In some cases, path estimation module 230 may consider geographical features when computing an estimated path. For example, path estimation module 230 may query a topographical map to identify the topography along an estimated path. In some cases, path estimation module 230 may adjust the estimated path based on the topography indicated in the queried topographical map. Path estimation module 230 may be configured to identify structures along the estimated path and customers that subscribe to an events subscription service in order to identify structures associated with subscribing customers that are located along the estimated path. Accordingly, notification module 215 may generate and send notifications to the identified subscribing customers whose associated structures lie along the estimated path of the event.

In some embodiments, notification module 215 may send a notification to a user of a structure outside the predetermined geographic area based on the estimated path. For example, path estimation module 230 may determine that the detected event is likely to spread beyond the predetermined geographic area. Thus, notification module 215 may indicate, in the notification, a number of structures that are confirmed to have detected the event, and indicate, on a graphical map, a location of each structure confirmed to have detected the event. In some cases, notification module 215 may include a graphical map in the notification message. Additionally, or alternatively, notification module 215 may include a link to a map application such as GOOGLE MAPS®, etc., where the notification module 215 indicates the affected structures on the map application. In some embodiments, notification module 215 may send a notification to a user using a selected messaging service. Additionally, or alternatively, notification module 215 may send the notification via a selected social network such as FACEBOOK®, GOOGLE+®, etc.

Figure 3:
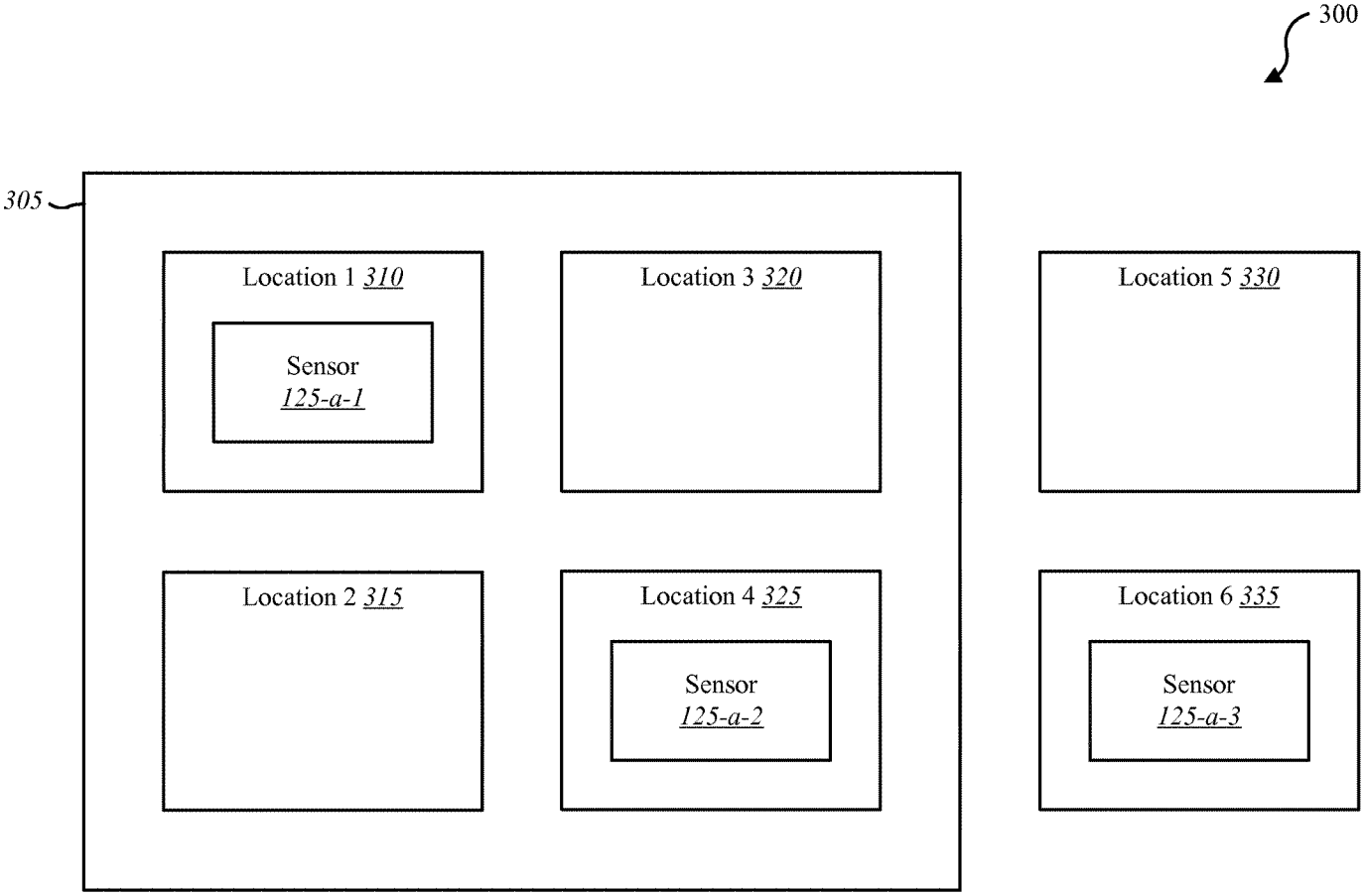
FIG. 3 is a block diagram illustrating one example of an environment for crowdsourcing detected events to improve awareness regarding detected events.

FIG. 3 is a block diagram illustrating one example of an environment 300 for crowdsourcing detected events to improve the timely notification regarding the detection of events of particular interest related to a predetermined geographic area. As depicted, the predetermined geographic area 305 (e.g., neighborhood, etc.) may include location 1 310, location 2 315, location 3 320, and location 4 325. Additionally, location 5 330 and location 6 335 are depicted as being located outside the predetermined geographic area 305. Examples of locations 1-6 include homes, places of business, buildings, outdoor areas, etc. Even though FIG. 3 depicts four locations within the specified area 305 and two locations outside the predetermined geographic area 305, it is understood that there may be less or more locations than four within the predetermined geographic area 305 and less or more locations than two outside the predetermined geographic area 305. As illustrated, location 1 310, location 4 325, and location 6 335 may each include at least one sensor 125-*a*. Each sensor 125-*a* may be one example of sensor 125 depicted in FIG. 1. Accordingly, each of the one or more sensors 125-*a* may detect one or more particular events. In some cases, at least one of the locations depicted as including a sensor may include a building automation system. As depicted, location 2 315, location 3 320, and location 5 330 may lack a sensor.

As explained above, sensor 125-*a*-1 may detect an event such as flooding. An events module 145 associated with sensor 125-*a*-1 may determine that the detected event is isolated to a particular location within area 305. For example, location 1 310 may be a home, and an events module 145 may determine that the flooding is isolated to the home at location 1 310. In some cases, the events module 145 associated with sensor 125-*a*-1 may determine that the detected event is not isolated to a single location, such as a home or building, but that the detected event is associated with two or more locations within area 305. Accordingly, the events module 145 may generate a notification to a user associated with location 1 310. Additionally, events module 145 may generate a notification to a user associated with location 2 315, even though location 2 315 does not include a sensor of the type that detected the event.

In some cases, the events module 145 may determine that the detected event is associated with one or more locations outside area 305. For example, the events module 145 may determine that the detected event has spread outside area 305 and/or may estimate a path that the event is likely to take and generate notifications accordingly. For example, the events module 145 may determine that the flooding event is spreading towards an area outside of area 305 and may determine that one or more locations lie within the estimated path of the event, such as location 5 330 and/or location 6 335. Accordingly, the events module 145 may generate notifications for the one or more locations that lie within the estimated path such as location 5 330, even though location 5 330 does not include a sensor of the type that detected the event.

Figure 4:
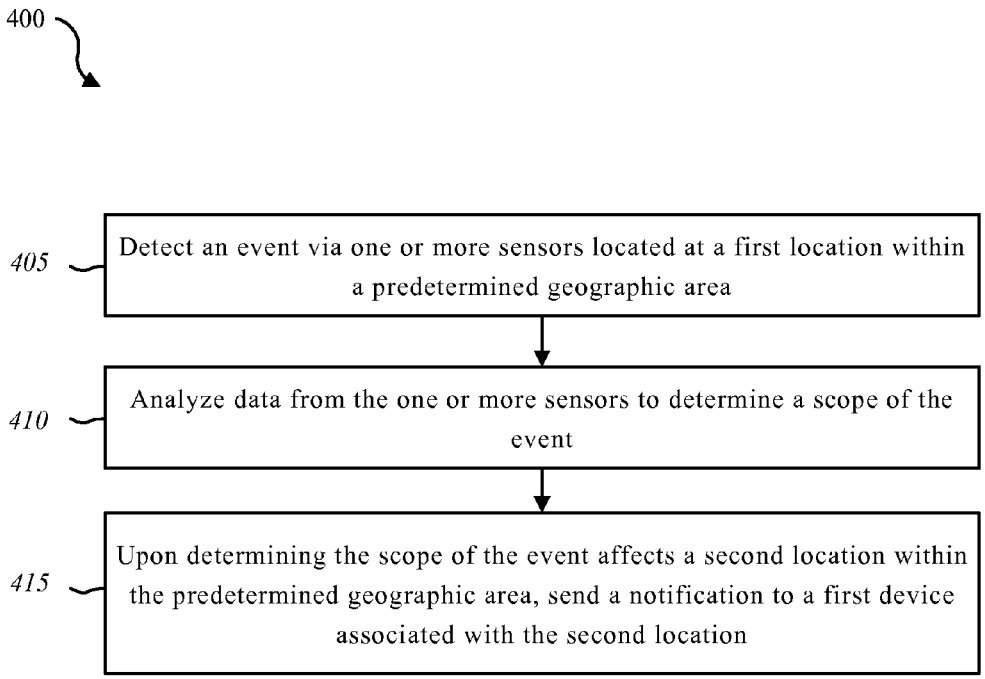
FIG. 4 is a flow diagram illustrating one embodiment of a method for crowdsourcing detected events.

FIG. 4 is a flow diagram illustrating one embodiment of a method 400 for crowdsourcing detected events. In some configurations, the method 400 may be implemented by the events module 145 illustrated in FIG. 1 or 2. In some configurations, the method 400 may be implemented in conjunction with the application 140 and/or the user interface 135 illustrated in FIG. 1.

At block 405, an event may be detected via one or more sensors located at a first location within a predetermined geographic area. The event may include a wildfire, a tsunami, a tornado, flooding, a hurricane, a typhoon, a dust storm, high winds, biological contamination, chemical contamination, a burglary, property damage, and the like. The one or more sensors may be configured to detect at least one of these events. At block 410, data from the one or more sensors may be analyzed to determine a scope of the event. At block 415, upon determining the scope of the event affects a second location within the predetermined geographic area, a notification may be sent to a first device associated with the second location. In some embodiments, the second location fails to include a sensor of the type that detects the event. The notification may be sent using a messaging service (e.g., email, text message, recording phone message, etc.), a social network, and the like.

Figure 5:
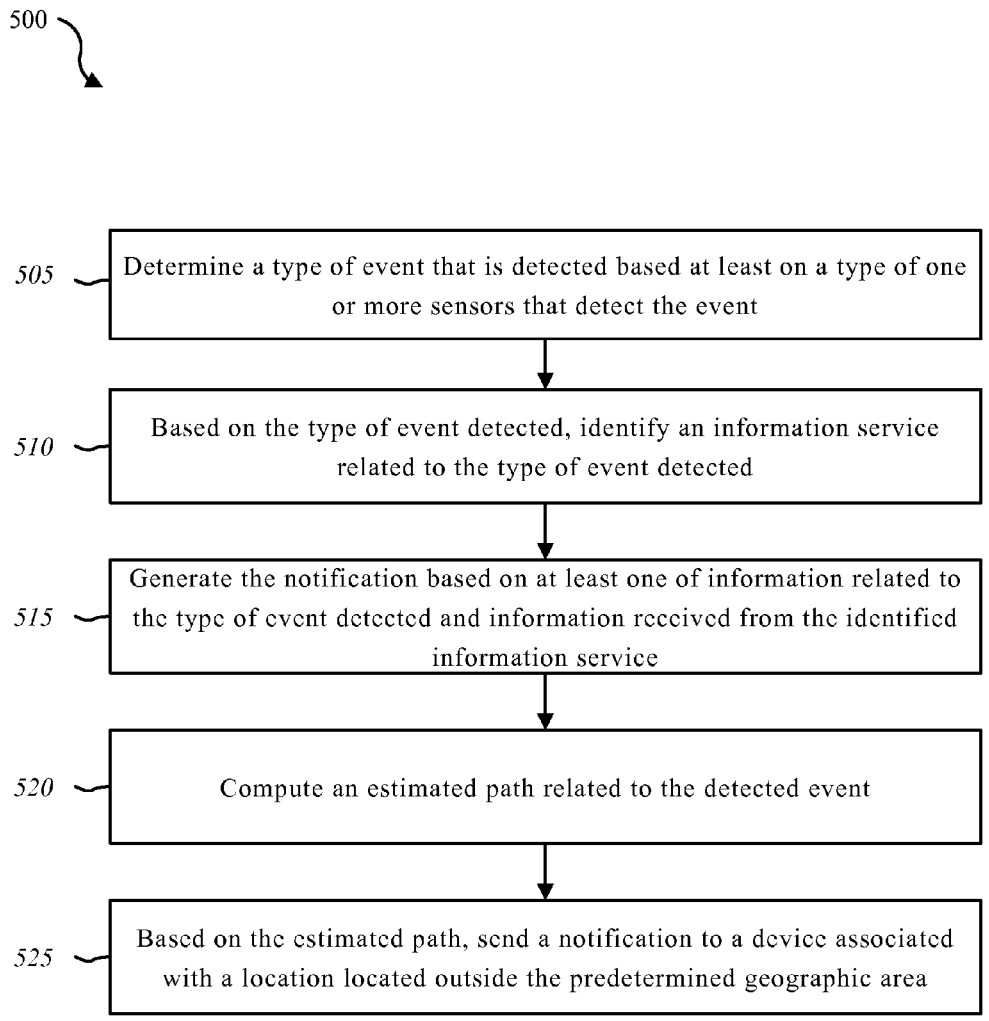
FIG. 5 is a flow diagram illustrating one embodiment of a method for improving awareness of detected events.

FIG. 5 is a flow diagram illustrating one embodiment of a method 500 for improving awareness of detected events. In some configurations, the method 500 may be implemented by the events module 145 illustrated in FIG. 1 or 2. In some configurations, the method 500 may be implemented in conjunction with the application 140 and/or the user interface 135 illustrated in FIG. 1.

At block 505, a type of event may be determined that is detected based at least on a type of one or more sensors that detect the event. At block 510, based on the type of event detected, an information service related to the type of event detected may be identified. At block 515, the notification may be generated based on at least one of information related to the type of event detected and information received from the identified information service. At block 520, an estimated path related to the detected event may be computed. In some embodiments, the estimated path may be computed by analyzing information from the one or more sensors located within the predetermined geographic area, information from one or more sensors located outside the predetermined geographic area, and/or information received from the information service related to the type of event detected. At block 525, based on the estimated path, a notification may be sent to a device associated with of a location outside the predetermined geographic area. Thus, a sensor associated with a first location may detect an event. Upon determining the event affects more than the first location, a notification may be sent to a first device associated with a second location located within the predetermined geographic area. Additionally, based on an estimated path, a notification may be sent to a second device associated with a third location located outside the predetermined geographic area. In some cases, the notification may indicate one or more locations that are confirmed to have detected the event and/or indicate on a graphical map a position of each location confirmed to have detected the event. In some cases, the notification may indicate the locations estimated to be affected by the detected event (e.g., on a map, in a list, etc.), including locations without a sensor capable of detecting the event.

Figure 6:
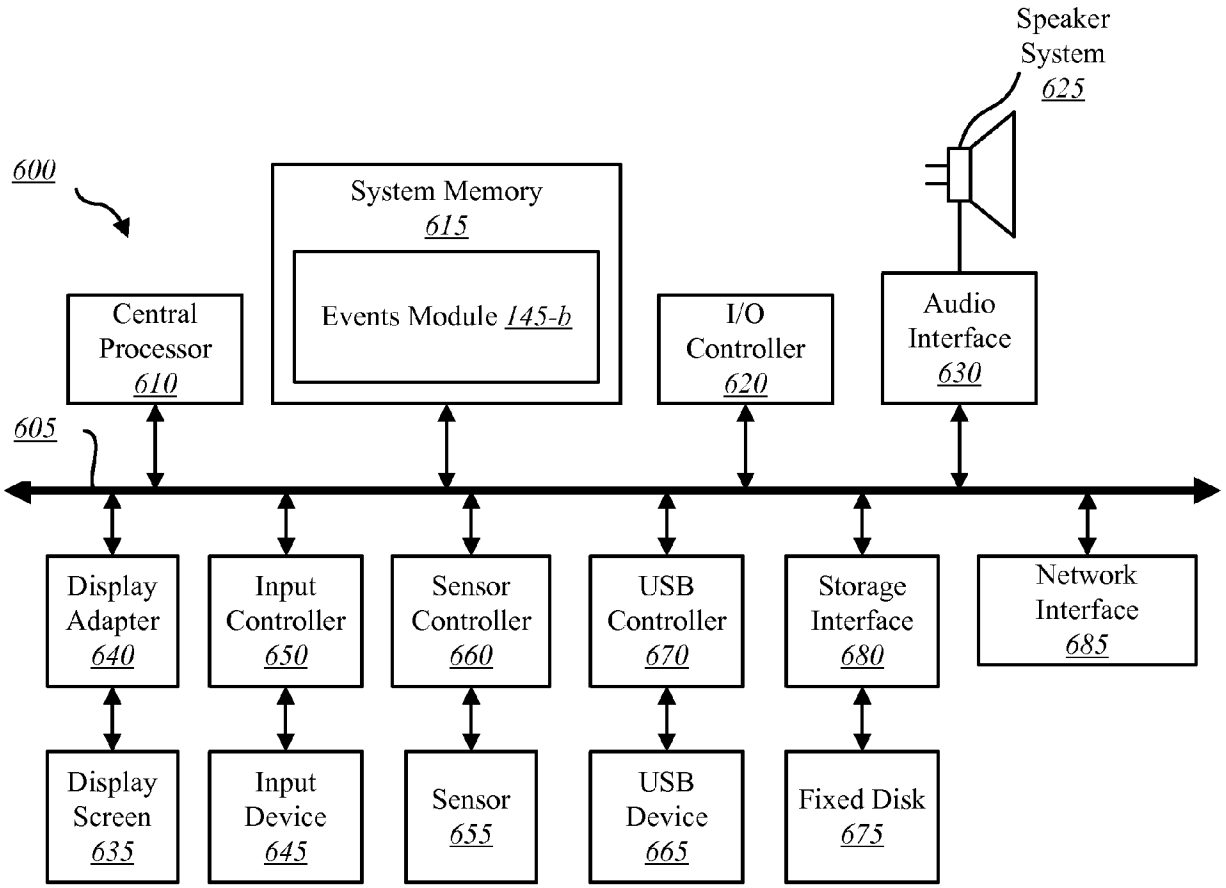
FIG. 6 depicts a block diagram of a computer system suitable for implementing the present systems and methods.

FIG. 6 depicts a block diagram of a controller 600 suitable for implementing the present systems and methods. The controller 600 may be an example of device 105, computing device 150, and/or building automation controller 155 illustrated in FIG. 1. In one configuration, controller 600 includes a bus 605 which interconnects major subsystems of controller 600, such as a central processor 615, a system memory 620 (typically RAM, but which may also include ROM, flash RAM, or the like), an input/output controller 625, an external audio device, such as a speaker system 630 via an audio output interface 635, an external device, such as a display screen 635 via display adapter 640, an input device 645 (e.g., remote control device interfaced with an input controller 650), multiple USB devices 665 (interfaced with a USB controller 670), and a storage interface 680. Also included are at least one sensor 655 connected to bus 605 through a sensor controller 660 and a network interface 685 (coupled directly to bus 605).

Bus 605 allows data communication between central processor 615 and system memory 620, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, the events module 145-*b* to implement the present systems and methods may be stored within the system memory 620. Applications (e.g., application 140) resident with controller 600 are generally stored on and accessed via a non-transitory computer readable medium, such as a hard disk drive (e.g., fixed disk 675) or other storage medium. Additionally, applications can be in the form of electronic signals modulated in accordance with the application and data communication technology when accessed via interface 685.

Storage interface 680, as with the other storage interfaces of controller 600, can connect to a standard computer readable medium for storage and/or retrieval of information, such as a fixed disk drive 675. Fixed disk drive 675 may be a part of controller 600 or may be separate and accessed through other interface systems. Network interface 685 may provide a direct connection to a remote server via a direct network link to the Internet via a POP (point of presence). Network interface 685 may provide such connection using wireless techniques, including digital cellular telephone connection, Cellular Digital Packet Data (CDPD) connection, digital satellite data connection, or the like. In some embodiments, one or more sensors (e.g., motion sensor, smoke sensor, glass break sensor, door sensor, window sensor, carbon monoxide sensor, and the like) connect to controller 600 wirelessly via network interface 685.

Many other devices or subsystems (not shown) may be connected in a similar manner (e.g., entertainment system, computing device, remote cameras, wireless key fob, wall mounted user interface device, cell radio module, battery, alarm siren, door lock, lighting system, thermostat, home appliance monitor, utility equipment monitor, and so on). Conversely, all of the devices shown in FIG. 6 need not be present to practice the present systems and methods. The devices and subsystems can be interconnected in different ways from that shown in FIG. 6. The aspect of some operations of a system such as that shown in FIG. 6 are readily known in the art and are not discussed in detail in this application. Code to implement the present disclosure can be stored in a non-transitory computer-readable medium such as one or more of system memory 620 or fixed disk 675. The operating system provided on controller 600 may be iOS®, ANDROID®, MS-DOS®, MS-WINDOWS®, OS/2®, UNIX®, LINUX®, or another known operating system.

Moreover, regarding the signals described herein, those skilled in the art will recognize that a signal can be directly transmitted from a first block to a second block, or a signal can be modified (e.g., amplified, attenuated, delayed, latched, buffered, inverted, filtered, or otherwise modified) between the blocks. Although the signals of the above described embodiment are characterized as transmitted from one block to the next, other embodiments of the present systems and methods may include modified signals in place of such directly transmitted signals as long as the informational and/or functional aspect of the signal is transmitted between blocks. To some extent, a signal input at a second block can be conceptualized as a second signal derived from a first signal output from a first block due to physical limitations of the circuitry involved (e.g., there will inevitably be some attenuation and delay). Therefore, as used herein, a second signal derived from a first signal includes the first signal or any modifications to the first signal, whether due to circuit limitations or due to passage through other circuit elements which do not change the informational and/or final functional aspect of the first signal.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A computer-implemented method for crowdsourcing detected events, comprising:

detecting an event associated with a first area inside a first structure or a second area outside of the first structure via one or more sensors, wherein the first structure is located at a first location within a predetermined geographic area;

identifying a type of the event related to the first structure based at least in part on sensor data of the one or more sensors at the first location;

computing an estimated path of the event based at least in part on the type of the event and a topographical map including a structure, terrain, or both of the predetermined geographic area;

analyzing the estimated path to determine a scope of the event;

identifying a structure associated with one or more subscribed users along the estimated path;

upon determining that the scope of the event directly affects a second structure at a second location associated with a subscribed user of the one or more subscribed users within the predetermined geographic area based at least in part on determining that the detected event will affect the second structure at the second location based at least in part on the analyzed estimated path, sending a notification to a first device associated with the second structure at the second location using a service that enables notification based at least in part on detected events associated with one or more sensors of a subscribed user location, the first structure at the first location and the second structure at the second location each comprise a home automation system and the service the enables the notification is provided by the home automation system of the second structure at the second location;

determining that the scope of the event directly affects a third structure at a third location that is absent of a home automation system based at least in part on comparing timing information and proximity information associated with the analyzed estimated path and event information provided by a third party service; and upon determining that the scope of the event directly affects the third structure at the third location that is absent of the home automation system and associated with a second subscribed user based at least in part on comparing the timing information and the proximity information associated with the analyzed estimated path and the event information provided by the third party service, sending to a first device associated with the third location using the service that enables notification, a second notification different from the notification based at least in part on the third structure at the third location being absent of the home automation system;

wherein the first location is different than the second location.

2. The method of claim 1, wherein the second location fails to include a sensor capable of detecting the event.

3. The method of claim 1, further comprising:

determining the type of event that is detected based at least on a type of the one or more sensors.

4. The method of claim 3, further comprising:

based on the type of event detected, identifying an information service related to the type of event detected.

5. The method of claim 4, further comprising:

generating the notification based on at least one of information related to the type of event detected and information received from the identified information service.

6. The method of claim 4, further comprising:

computing the estimated path related to the detected event by analyzing at least one of information from the one or more sensors located within the predetermined geographic area; information from one or more sensors located outside the predetermined geographic area; and information received from the information service related to the type of event detected.

7. The method of claim 6, further comprising:

based on the estimated path, sending a notification to a second device associated with the third location outside the predetermined geographic area.

8. The method of claim 1, further comprising:

indicating, in the notification, a number of locations that are confirmed to have detected the event; and indicating, on a graphical map, a position of each location confirmed to have detected the event.

9. The method of claim 1, further comprising:

sending the notification using a selected messaging service.

10. The method of claim 1, further comprising:

sending the notification via a selected social network.

11. The method of claim 1, wherein the event comprises at least one of a wildfire, a tsunami, a tornado, flooding, a hurricane, a typhoon, a dust storm, high winds, biological contamination, chemical contamination, burglary, property damage, and wherein the one or more sensors are configured to detect at least one of these events.

12. A computing device configured for crowdsourcing detected events, comprising:

a processor;

memory in electronic communication with the processor;

instructions stored in the memory, the instructions being executable by the processor to:

detect an event via one or more sensors located at a first location within a predetermined geographic area;

identify a type of the event related to the first location based at least in part on sensor data of the one or more sensors at the first location;

compute an estimated path of the event based at least in part on the type of the event and a topographical map including a structure, terrain, or both of the predetermined geographic area;

determine a scope of the event based at least in part on the computed estimated path of the event;

identify a structure associated with one or more subscribed users along the estimated path;

upon determining that the scope of the event directly affects a second location associated with a subscribed user of the one or more subscribed users within the predetermined geographic area based at least in part on the estimated path, send a notification to a first device associated with the second location using a service that enables notification based at least in part on detected events associated with one or more sensors of a subscribed user location, the first location and the second location each comprise a home automation system and the service the enables the notification is provided by the home automation system of the second location;

determining that the scope of the event directly affects a third location that is absent of a home automation system based at least in part on comparing timing information and proximity information associated with the analyzed estimated path and event information provided by a third party service; and upon determining that the scope of the event directly affects a third location that is absent of a home automation system and associated with a second subscribed user based at least in part on comparing the timing information and the proximity information associated with the analyzed estimated path and the event information provided by the third party service, sending to a first device associated with the third location using the service that enables notification, a second notification different from the notification based at least in part on the third location being absent of the home automation system;

wherein the first location is different than the second location.

13. The computing device of claim 12, wherein the instructions are executable by the processor to:

determine the type of event that is detected based at least on a type of the one or more sensors.

14. The computing device of claim 13, wherein the instructions are executable by the processor to:

identify, based on the type of event detected, an information service related to the type of event detected.

15. The computing device of claim 14, wherein the instructions are executable by the processor to:

generate the notification based on at least one of information related to the type of event detected and information received from the identified information service.

16. The computing device of claim 14, wherein the instructions are executable by the processor to:

compute the estimated path related to the detected event by analyzing at least one of information from the one or more sensors located within the predetermined geographic area; information from one or more sensors located outside the predetermined geographic area; and information received from the information service related to the type of event detected.

17. The computing device of claim 16, wherein the instructions are executable by the processor to:

send, based on the estimated path, a notification to a second device associated with the third location outside the predetermined geographic area.

18. A computer-program product for crowdsourcing, by a processor, detected events, the computer-program product comprising a non-transitory computer-readable medium storing instructions thereon, the instructions being executable by the processor to:

monitor a first area inside a first structure and a second area outside of the first structure via one or more sensors;

detect an event associated with the first area or the second area via the one or more sensors, wherein the first structure is located at a first location within a predetermined geographic area;

identify a type of the event related to the first structure based at least in part on sensor data of the one or more sensors at the first location;

compute an estimated path of the event based at least in part on the type of the event and a topographical map including a structure, terrain, or both of the predetermined geographic area;

analyze the estimated path to determine a scope of the event;

identify a structure associated with one or more subscribed users along the estimated path;

upon determining that the scope of the event directly affects a second structure at a second location associated with a subscribed user of the one or more subscribed users within the predetermined geographic area based at least in part on determining whether the detected event is an isolated event based at least in part on the analyzed estimated path, send a notification to a first device associated with the second structure at the second location using a service that enables notification based at least in part on detected events associated with one or more sensors of a subscribed user location, the first structure at the first location and the second structure at the second location each comprise a home automation system and the service the enables the notification is provided by the home automation system of the second structure at the second location;

determining that the scope of the event directly affects a third structure at a third location that is absent of a home automation system based at least in part on comparing timing information and proximity information associated with the analyzed estimated path and event information provided by a third party service; and upon determining that the scope of the event directly affects the third structure at the third location that is absent of the home automation system and associated with a second subscribed user based at least in part on comparing the timing information and the proximity information associated with the analyzed estimated path and the event information provided by the third party service, send to a first device associated with the third location using the service that enables notification, a second notification different from the notification based at least in part on the third structure at the third location being absent of the home automation system;

wherein the first location is different than the second location.

19. The computer-program product of claim 18, wherein the second location fails to include a sensor capable of detecting the event.

* * * * *